United States Patent [19]

Green

[11] Patent Number: 4,522,524

[45] Date of Patent: Jun. 11, 1985

[54] DISPOSABLE TOOTHBRUSH WITH INTEGRAL DENTIFRICE

[76] Inventor: Arlene Green, 1427 Thornberry Rd., Wyncote, Pa. 19095

[21] Appl. No.: 518,430

[22] Filed: Jul. 29, 1983

[51] Int. Cl.[3] ..... A45D 44/18; B43M 11/06

[52] U.S. Cl. ..... 401/183; 401/286; 132/84 B

[58] Field of Search ..... 401/134, 135, 171, 176, 401/150, 270, 274, 275, 276, 286, 288, 183, 184, 401/185, 186

[56] References Cited

U.S. PATENT DOCUMENTS

| | | | |
|---|---|---|---|
| 1,134,865 | 4/1915 | Jones | 401/286 |
| 1,701,030 | 2/1929 | Collins | 401/286 |
| 2,717,101 | 9/1955 | Van Handel | 401/176 |
| 3,284,838 | 11/1966 | Bieganowski | 401/286 |
| 3,936,200 | 2/1976 | O'Rourke | 401/270 |
| 4,121,891 | 10/1978 | Barron | 401/176 |
| 4,139,312 | 2/1979 | Marano et al. | 401/176 |
| 4,201,490 | 5/1980 | D'Angelo | 401/270 |
| 4,221,492 | 9/1980 | Boscardin et al. | 401/288 |

*Primary Examiner*—Richard J. Apley

*Assistant Examiner*—Carolyn A. Harrison

*Attorney, Agent, or Firm*—John W. Logan, Jr.

[57] ABSTRACT

An integrated dentifrice and brushing container for use with a disposable toothbrush of the type comprising: a tubular stem for holding a bristle-carrying head formed integrally of the stem portion, an enlarged dentifrice holding chamber within the tubular stem, an internal passage extending between the dentifrice chamber and the bristle portion terminating in an aperture adjacent the bed of imbedded bristles. The head end of the assembly at the back of the bristles is provided with a position-adjustable valving member which alternately seals or opens the dentifrice outlet passage from the chamber to adjacent to the bristles. The slideable member is provided with an external tab which protrudes sufficiently to assure manual grasping and reciprocating position adjustment by thumb action.

The head portion and bristles are formed of conventional materials like nylon bristles and the head of tinted plastic, while the stem portion is preferably formed of a plastic, preferably one which is readily deformable upon manual compression, to express dentifrice toward the bristles.

2 Claims, 11 Drawing Figures

DISPOSABLE TOOTHBRUSH WITH INTEGRAL DENTIFRICE

FIELD OF THE INVENTION

This invention relates to a disposable toothbrush and, more particularly, to a brush which carries a supply of dentifrice, either as paste or liquid, which is expressable through a passageway in the brush stem to the bristle array upon selective manipulation.

BACKGROUND OF THE INVENTION

Brushing devices have included those wherein the dentifrice supply was intended to be made integral with some form of brushing portion for dispensing the dentifrice. See U.S. Pat. No. 3,879,139 issued April 22, 1975.

Typical oral hygiene involves the separate purchase of toothbrush and dentifrice, the storage and wasteful dispensing of the dentifrice by repetitive tube squeezing, and the overuse of permanent-type toothbrushes well beyond their hygienic periods of use. The American Dental Association has urged the use of soft bristles for better care of gums. Still, teeth require vigorous brushing, such that after daily brushing, the soft bristles should be dispensed within a short period and replaced, for a good dental hygiene, to further avoid the harboring of mouth bacteria from earlier periods of oral infection. The novel device is particularly well adapted to use with but one hand, which is a special boon to permanently or temporarily handicapped persons, such as hospital patients who are partially immobilized, arthritis victims, and persons lacking normal digital capabilities. It presents a handy prophylaxis means for frequent travelers.

The present device permits persons to attend to their oral hygiene personally and with dignity. The costs of use of multiple disposable brushes over a period of time is offset by more economical use of dentifrice and the enhanced oral prophylaxis with fresh toothbrush use.

The present invention will obviate the need for purchase of a dentifrice tube separate from the brush and all of the daily routine involved in conventional dentifrice application to teeth. It also minimizes purchase of dentifrice amounts well in excess of current needs by limiting supply to immediate requirements.

It is, therefore, a principal object of the invention to provide a low cost, mostly plastic components toothbrush including an integral dentifrice supply, conserved conveniently until needed and made practically disposable upon dentifrice depletion.

Another object of the invention is to provide a disposable toothbrush in which liquid dentifrice is retained in the stem portion and dispersed selectively upon digital valving of the sealing closure member over the dentifrice chamber.

It is a further object to provide a disposable toothbrush integral with paste dentifrice supply which is readily expressed upon compression of the flexible stem portion with one hand.

Yet a still further object is to provide a disposable toothbrush with a contained dentifrice supply that is expressed by thumb manipulation of the stem portion only.

These and other objects and advantages are accomplished by the teaching of the following specification, drawing and claims.

SUMMARY OF THE INVENTION

The present objects are accomplished by providing an integrated dentifrice container, for use with a disposable toothbrush of the type comprising: a tubular stem for holding a bristle-carrying head formed integrally of the stem portion, an enlarged dentifrice holding chamber within the tubular stem, an internal passage extending between the dentifrice chamber and the bristle portion and terminating in an aperture (or a plurality of them), adjacent the bed of imbedded bristles. The head end of the assembly at the back of the bristles is provided with a position-adjustable, rail-like in x-section solid member which alternately seals or opens the dentifrice outlet passage from the chamber to adjacent to the bristles. When held in the closed position, it precludes the wasting escape of dentifrice from the holding chamber by inadvertent tipping or compression of the stem body. The slidable member is provided with an external tab which protrudes sufficiently to assure manual grasping and reciprocating position adjustment by thumb action.

The head portion and bristles are formed of conventional materials like nylon bristles, the head of a thermosetting, tinted, plastic, while the stem portion is preferably formed of a clear or translucent plastic, preferably one which is readily deformable upon manual compression, to express dentifrice toward the bristles, but such a plastic stem still has a sufficient memory and/or resilience to return to its normal configuration upon the release of compressive pressure.

In an alternate embodiment, the compressible stem portion is provided with a non-removable closure means at its free end through which dentifrice was earlier loaded into the chamber.

In another embodiment, the locking closure cap and deformable stem are omitted and replaced by an internal piston which forms a movable wall against the stored dentifrice and serves to express dentifrice adjacent the bristle portion as directed by digital manipulation of the brush holder.

Preferred embodiments of the invention are described in detail in the following description and accompanying drawing, in which:

FIG. 1*a* is a perspective view of the manner of initially grasping the device of the present invention;

FIG. 1*b* is a perspective view of the present device as it would be operated by the brush user.

Figures 1A, 1B, 2, 3, 4, 5, 6, 7, 8, 9, 10:
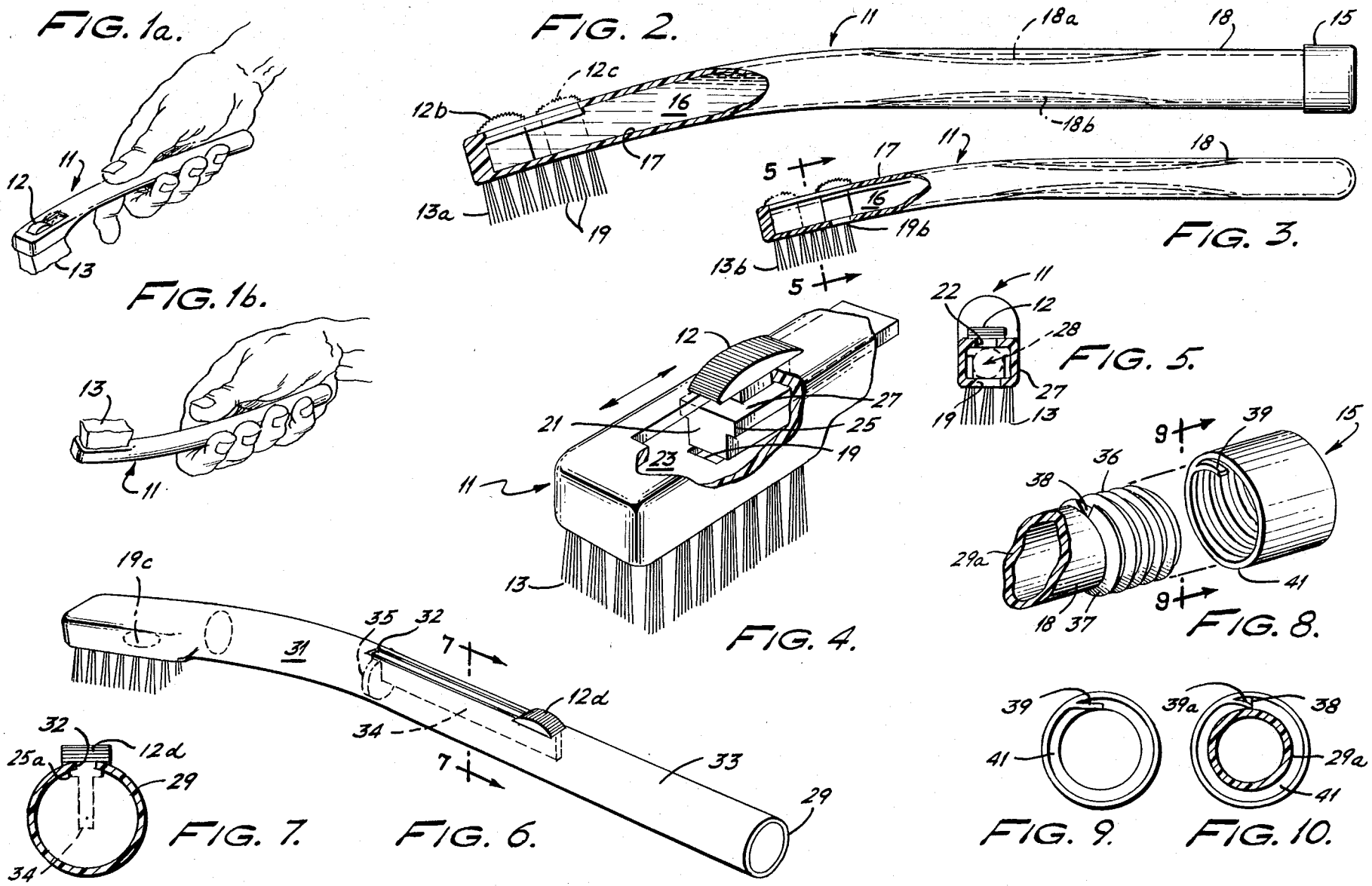
FIG. 2 is a side elevational view of the integrated brushing and dentifrice container device of the present invention, with portions cut away, depicting details of the brushing head in both the open and closed positions and having a locking cap.
FIG. 3 is a first alternate embodiment also in elevation of the brushing device omitting the locking cap feature on the barrel end.
FIG. 4 is an enlarged, fragmentary view of the bristle holding portion detail, partially broken away, showing the actuating tab and valve construction.
FIG. 5 is a cross-sectional view taken through the bristle holding portion along lines 5—5 in FIG. 3.
FIG. 6 is a second alternate embodiment of the brushing device having a thumb tab-actuated piston mechanism (seen in phantom) for expressing dentifrice toward the bristle portion, as seen in perspective.
FIG. 7 is an enlarged, cross-sectional view taken through the barrel portion along lines 7—7 of FIG. 6.
FIG. 8 is an exploded, partial perspective view of the capped end of the first embodiment of FIG. 2.
FIG. 9 is a head-on view taken on the threaded closure seen along lines 9—9 of FIG. 8.
FIG. 10 is a vertical sectional view of the broken away stem terminus while in locking engagement with the stem closure member.

Referring now to FIG. 1, the manner in which a righthand person would grasp and tilt the brushing device, generally 11, of the invention is seen just prior to activating the external tabbed 12 to admit dentifrice adjacent the bristle section 13. After dentifrice deposit in the bed of the bristles, the tabbed valve would be retracted to shut off added dentifrice deposition while in use then rotated for brushing to the position shown in FIG. 2.

Averting to a preferred embodiment shown in FIG. 2, there is depicted a brushing device with conventional bristle array 13*a*, an adjustable external tab 12*b* in the dentifrice flow position (also in phantom position 12*c*) with the dentifrice passage (not seen) being closed off.

Barrel or holding stem portion 18 is preferably tubular in shape throughout its length terminating in cylindrical closures member 15, through which dentifrice, either liquid or paste, is conveniently preloaded at the device assembly plant into generally cylindrical holding chamber 16. The walls 17 of chamber 16 are fabricated from a clear or translucent material of construction, like plastic, which will admit of repeated deformations and recoveries upon digital compression and release.

Conveniently, the material is a thin walled thermoplastic material, for example, of cellulose propinate tubing. Alternatively, sheeting of polyvinyl chloride is useful. The lateral walls are chosen with a thickness or dimension that makes them normally rigid, but still sufficiently thin, as to permit the compression/restoration cycles performance described above. Note the compressed position of stem 11 (digitial grasping omitted) is shown in phantom at 18*a* and 18*b*.

There is provided in the embodiment depicted in FIG. 3, an alternate configuration, omitting the locking cap featured on the stem end, being otherwise of identical construction. Here loading of dentifrice, most conveniently of the liquid form, would be done by intubation through the passageway 19*b* provided adjacent the bed of bristles, followed by valve retraction to the sealed position.

The enlarged perspective view of FIG. 4 displays the configuration and valve interplay of thumb tab 12, valve body 21 and dentifrice outlet 19. It will be seen that valve 21 and its pinned tab 12 move, longitudinally and reciprocally, within longitudinal slot 22, which is open to the opposing side of the bristle array. As dentifrice enters head reservoir 23, it flows into the bristle bed, as outlet 19 is exposed (from the underside of the hidden valve face) of front valve end 24. So long as valve 21 is moved forwardly in the slot 22, outflow of dentifrice is permitted upon stem compression, or liquid flows into the bristles upon downward tilting of the device as seen in FIG. 1*a*. The outwardly flanged upper portions 25 of valve 21 extend beyond the periphery of slot 22, insuring sliding retention of the valve body within head chamber 23 despite plural reciprocal actions of the tab 11. The underface of valve body 21 (not seen) is wider than dentifrice outlet aperture 19 to insure sealing when in the non-flow mode. Finally, tab 12 can be secured to the top face 26 of valve 31, by adhesive or ultrasonic bonding, after the valve itself is positioned in the head portion 11 during device assembly.

The cross-sectional view of FIG. 5 reveals the substantially rectangular configuration of the rigid walls 27 of the bristle portion, dentifrice outlet 19 and the substantially circular, cross-section for internal passage 28 that communicates within the dentifrice chamber (not seen) of stem portion 11.

An alternate embodiment to the tab being positioned in the bristle portion is shown in FIG. 6, which omits both the stem end closure member and the reciprocating bristle head valve. The stem portion is also generally tubular in configuration and may open at its free end 29. The dentifrice, preferably pasty in this embodiment, is retained in the stem section 31 adjacent the bristle portion.

An extended, longitudinally disposed slot 32 which opens to the device surface, is positioned intermediate and centrally of the ends of the stem portions on the upper face 33. It accommodates the shank (not shown) of thumb-actuated tab 12*d*. The tab is pinned to the rearward upper edge of a rectangular elongated pusher rod 34, which is aligned within the stem portion and runs parallel to slot 32. The foward end of rod 34 is secured to cylindrical piston 35 which is disposed transversely within the outlet passage 31 and forms an essentially slideable seal within the internal walls of the stem portions. When the rod 34 is moved forward by thumb pressure on tab 12*d*, the piston 35 serving as a moving chamber wall, compresses the stored dentifrice, and expresses same into the bristle portion at the end of the bristle array, via a generally circular outlet part 19*c*, seen in phantom view, which can be otherwise configured. After several uses, when the tab 12*d* had reached its fully forward position within the stem, the dentifrice is expended and the device is disposed with.

As with the other embodiments, the device is provided with a slightly obtuse angle, intermediate the ends of the stem, so that during manual use, the bristles are biased inwardly of the stem portion toward the teeth (denture) to be brushed.

The substantially circular cross-section of the rigid tubular wall is rearwardly viewed, along line 7—7 of FIG. 6, as seen in FIG. 7. The flanged shank 25*a* which connects tab 12*d* and rod 34 is better seen in this view.

In the exploded, partial perspective of FIG. 8, the conventional right-handed threading is superimposed on the rear, free end wall 29*a* of stem portion 18. The most inward thread 37 is provided with deep notch 38 to complement the flexible protrusion 39 that abuts the inner edge 41 of closure member 15. After the dentifrice is loaded into the stem chamber (while the valve 21 at the opposing end is in the closed position), the closure cap is turned onto the threaded end until the protrusion 39 snaps into place behind notch 38, thereby locking the cap, precluding undesired reloading, inducing prompt disposal after dentifrice exhaustion.

In FIG. 9, a perspective view of the locking cap, taken along lines 9—9, shows the locking protrusion prior to engagement with the threaded stem end. After locking engagement of the mating parts, a vertical sectional view taken through the locking elements would appear as in FIG. 10, wherein the locked in-position of the cap protrusion 39 bowed downwardly into notch 38 becomes readily apparent.

In its broadest context, the present invention comprises disposable, integrated dentifrice dispenser and disposable toothbrush in which there is a: head portion integrally joined to said stem, a dentifrice holding chamber provided within the stem portion, an internal passage extending between the chamber and the head portion and connecting with an external opening into the region of the bristles, said device comprising: a storage portion wholly located within stem 11 providing the generally cylindrical chamber 16 for retaining a formed paste or a liquid dentifrice; an internal passage 17 of substantially the same cross-section profile as that of the dentifrice chamber communicating with the head portion; a longitudinally disposed, open slot 21 positioned in the head portion 11 on the side opposing the bristle carrying side; a valving plug 21 slidably retained within the head portion and disposed within the passage that admits dentifrice adjacent to the bristle portion when in one configuration and prevents dentifrice admission in its alternate configuration; a tab 12 fixedly secured to the valving plug which protrudes externally from the slot 21 sufficiently for digital engagement; the device being further formed into an obtuse angle intermediate the stem and head portions so that during use the bristle array is biased inwardly of the stem portion toward the denture to be brushed, and the holding chamber is fabricated from a manually deformable material of construction, usually plastic, which will admit of repeated deformations and recoveries upon digital compression and release.

From the foregoing, it will be seen that this invention is adapted to obtain all of the ends and objects hereinabove set forth, together with other advantages which are manifest and inherent. Clearly, many modifications and variations of the invention as hereinbefore set forth can be made without departing from the spirit and scope thereof, and, therefore, only such limitations should be imposed as are indicated by the appended claims.

What is claimed is:

1. A disposable dentifrice dispenser and toothbrush comprising:

(a) a generally cylindrical handle portion forming a dentifrice storage chamber;

(b) a hollow head portion of generally rectangular cross-sectional shape formed integral with said handle portion, said head portion having opposed parallel upper and lower walls;

(c) toothbrushing bristles extending outwardly from the lower wall of the head portion;

(d) an unrestricted internal passage joining the dentifrice storage chamber with the interior of the head portion, permitting unrestricted flow of dentifrice therethrough;

(e) a longitudinally disposed slot formed in the upper wall of the head portion;

(f) means defining a dispensing opening in the lower wall of the head portion for passage of the dentifrice;

(g) a valve member slidably retained within the head portion movable between forward and rearward positions, said valve member having an elongated upper flange portion thereof engaging the inner side of the upper wall of said head portion said valve member having a lower portion of lesser longitudinal and transverse extent than the upper portion engaging the inner surface of the lower wall of the head portion, thereby providing a bypass means around said valve member when in the rearward position; said valve member in the forward position thereof exposing said dispensing opening to permit passage of dentifrice therethrough and in the rearward position thereof engaging over and closing said dispensing opening;

(h) a tab fixedly secured to said movable valve member projecting upwardly through said slot to permit movement of said valve member between said forward and rearward positions;

(i) and the handle portion being fabricated from a manually deformable material which will admit of repeated deformations and recoveries upon being manually squeezed and released, whereby squeezing of the handle portion when said valve member is in its forward position will force dentifrice through the dispensing opening onto said bristles whereas inadvertent squeezing of said handle will not result in movement of said valve member from said rearward to said forward position.

2. The device of claim 1 in which the hand-held end of the handle portion is provided with a non-removable closing means through which the dentifrice is loaded into the chamber.

* * * * *